US011353235B2

(12) United States Patent
Mantenuto

(10) Patent No.: US 11,353,235 B2
(45) Date of Patent: Jun. 7, 2022

(54) REGISTER ASSEMBLY

(71) Applicant: MARBLE AND MARBLE LTD., Concord (CA)

(72) Inventor: Paolo Mantenuto, Concord (CA)

(73) Assignee: Marble and Marble Ltd., Concord (CA)

( * ) Notice: Subject to any disclaimer, the term of this patent is extended or adjusted under 35 U.S.C. 154(b) by 723 days.

(21) Appl. No.: 16/092,665

(22) PCT Filed: Jun. 15, 2016

(86) PCT No.: PCT/CA2016/050687
§ 371 (c)(1),
(2) Date: Oct. 10, 2018

(87) PCT Pub. No.: WO2017/214697
PCT Pub. Date: Dec. 21, 2017

(65) Prior Publication Data

US 2019/0128558 A1 May 2, 2019

(51) Int. Cl.
*F24F 13/08* (2006.01)
*F24F 13/06* (2006.01)

(52) U.S. Cl.
CPC ..... *F24F 13/082* (2013.01); *F24F 13/06* (2013.01)

(58) Field of Classification Search
CPC ..... F24F 13/082; F24F 13/06; F24F 13/068; F24F 13/08
USPC ..... 454/330, 290
See application file for complete search history.

(56) References Cited

U.S. PATENT DOCUMENTS 770,326 A * 9/1904 Slater ..... F24F 13/06 454/290
6,322,442 B1 * 11/2001 Cordell ..... F24F 13/06 454/290
6,494,780 B1 * 12/2002 Norbury, Jr. ..... F24F 13/06 454/155

(Continued)

FOREIGN PATENT DOCUMENTS

EP 1995532 A1 11/2008
JP 3-28647 A * 2/1991 ..... F24F 2007/003
KR 10-1528124 B1 6/2015

OTHER PUBLICATIONS

International Search Report and Written Opinion from counterpart International Application No. PCT/CA2016/050687 dated Feb. 24, 2017.

*Primary Examiner* — Jessica Yuen
(74) *Attorney, Agent, or Firm* — DLA Piper LLP (US)

(57) ABSTRACT

In one embodiment, the invention is a register assembly for inserting into floors, ceilings and walls, comprising a first open top box having a bottom surface, which defines a centrally disposed opening through which air flows from a first environment to a second environment. A support is disposed within the first open top box. A second open top box nests within the first open top box, and is supported by the support. A restraint is associated with the first and second box to restrain the second box within the first box. The first and second open top boxes are sized and dimensioned to be coplanar with each other when nested. A conduit is also defined between the first open top box bottom surface opening and the second open top box to flow air from the first environment to the second environment.

9 Claims, 6 Drawing Sheets

(56) References Cited

U.S. PATENT DOCUMENTS

| | | | | |
|---|---|---|---|---|
| 7,794,313 | B2 | 9/2010 | Ruberg | |
| 7,819,730 | B2 * | 10/2010 | Ascroft ..... | F24F 13/082<br>454/289 |

* cited by examiner

REGISTER ASSEMBLY

BACKGROUND

There are many different types of registers for air ducts. One common type is simply a faceplate that covers an air duct opening. The faceplate consists of a grid, series of louvers or ornamental designs. Many examples of faceplates include a mechanism to move the louvers to control the direction of air flow. Dampers, filters and humidifiers are also often integrated into registers for air ducts.

Registers are typically manufactured from a metal such as steel or aluminum, and plastic, and are usually rectangular or circular. Most registers for air ducts within floors are manufactured from steel or plastic, while aluminum is preferred for registers in walls and ceilings. Faceplates are usually manufactured to be slightly larger than the duct opening so that edge portions of the faceplate overlap the surrounding wall, ceiling or floor, which means the faceplate extends slightly away from the floor, ceiling or wall. The grid or louvered design is often unsightly and can mar the appearance of home surfaces. It is also unpleasant to tread upon registers installed in a floor.

Although it is known to manufacture faceplates with ornamental designs that blend in with surrounding walls, floors and ceilings, special tools and expertise are generally required. Such custom-made registers are also expensive.

What is required is a cost-effective air vent register that can be customized easily to match the surrounding floor, ceiling and walls.

SUMMARY

In one embodiment, the invention is a register assembly for inserting into floors, ceilings and walls, comprising a first open top box having a bottom surface, which defines a centrally disposed opening through which air flows from a first environment to a second environment. A support is disposed within the first open top box. A second open top box nests within the first open top box, and is supported by the support. A restraint is associated with the first and second box to restrain the second box within the first box. The first and second open top boxes are sized and dimensioned to be coplanar with each other when nested. A conduit is also defined between the first open top box bottom surface opening and the second open top box to flow air from the first environment to the second environment.

DRAWINGS

DESCRIPTION

The present invention is a register assembly for an air duct. The register assembly can be installed in a wall, ceiling or floor. In the example shown in FIG. 1, the register is installed in the floor (60) so that all components of the assembly are coplanar with each other, and with the surrounding floor.

Figure 2:
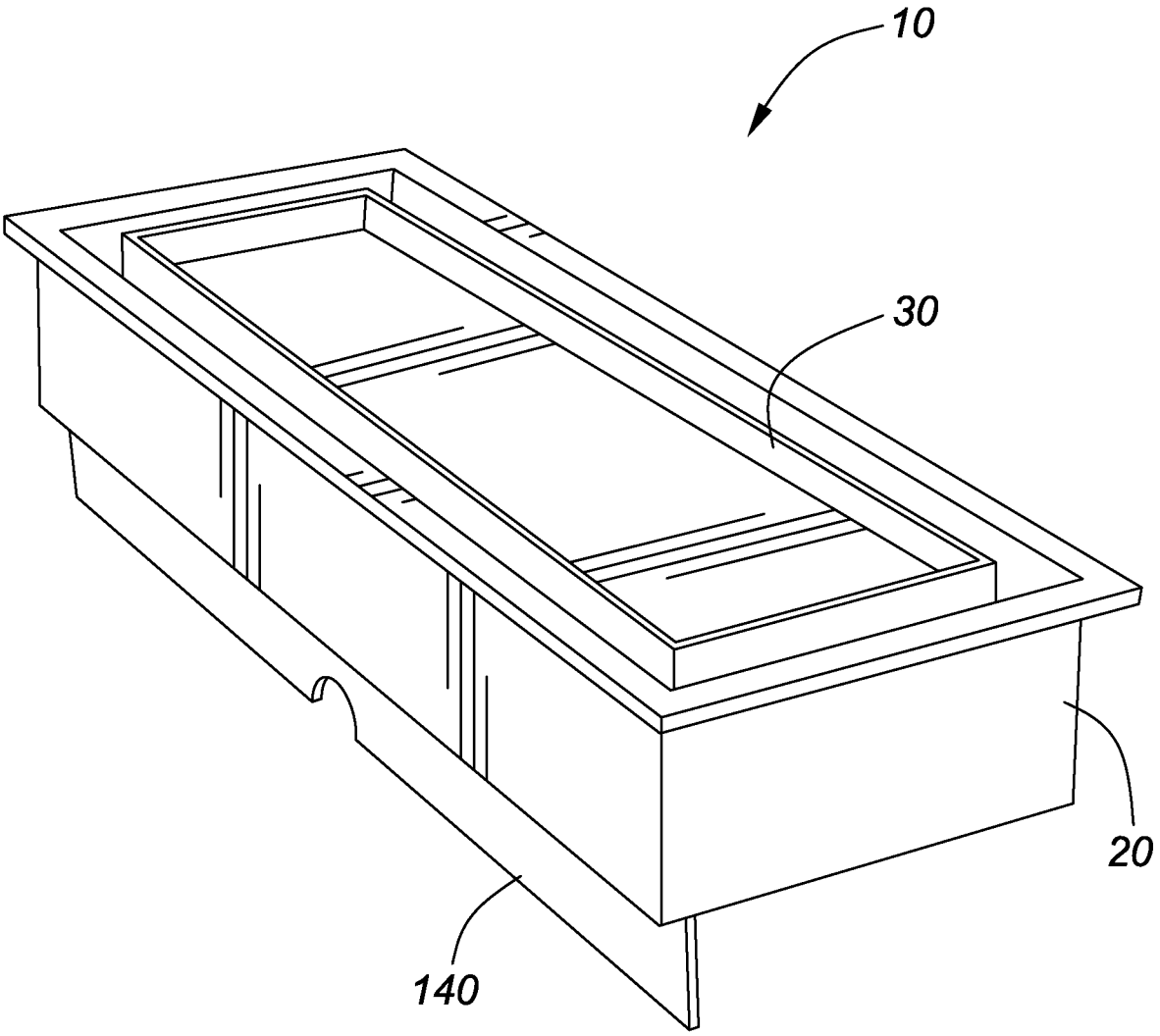
FIG. 2 is a perspective view of two components of the register assembly.

In its most basic form, the assembly is comprised of two components, namely a register body (20) and an insert (30) (see FIG. 2). As best viewed in FIG. 4, the register body (20) resembles an open top box comprising a bottom surface (150) and two pairs of opposing sidewalls (180, 190) enclosing an interior, into which the insert (30) is inserted (see also FIG. 2). The bottom surface (150) defines a centrally disposed opening (FIG. 5, 70) for air to flow from a first environment to a second environment.

Figure 1:
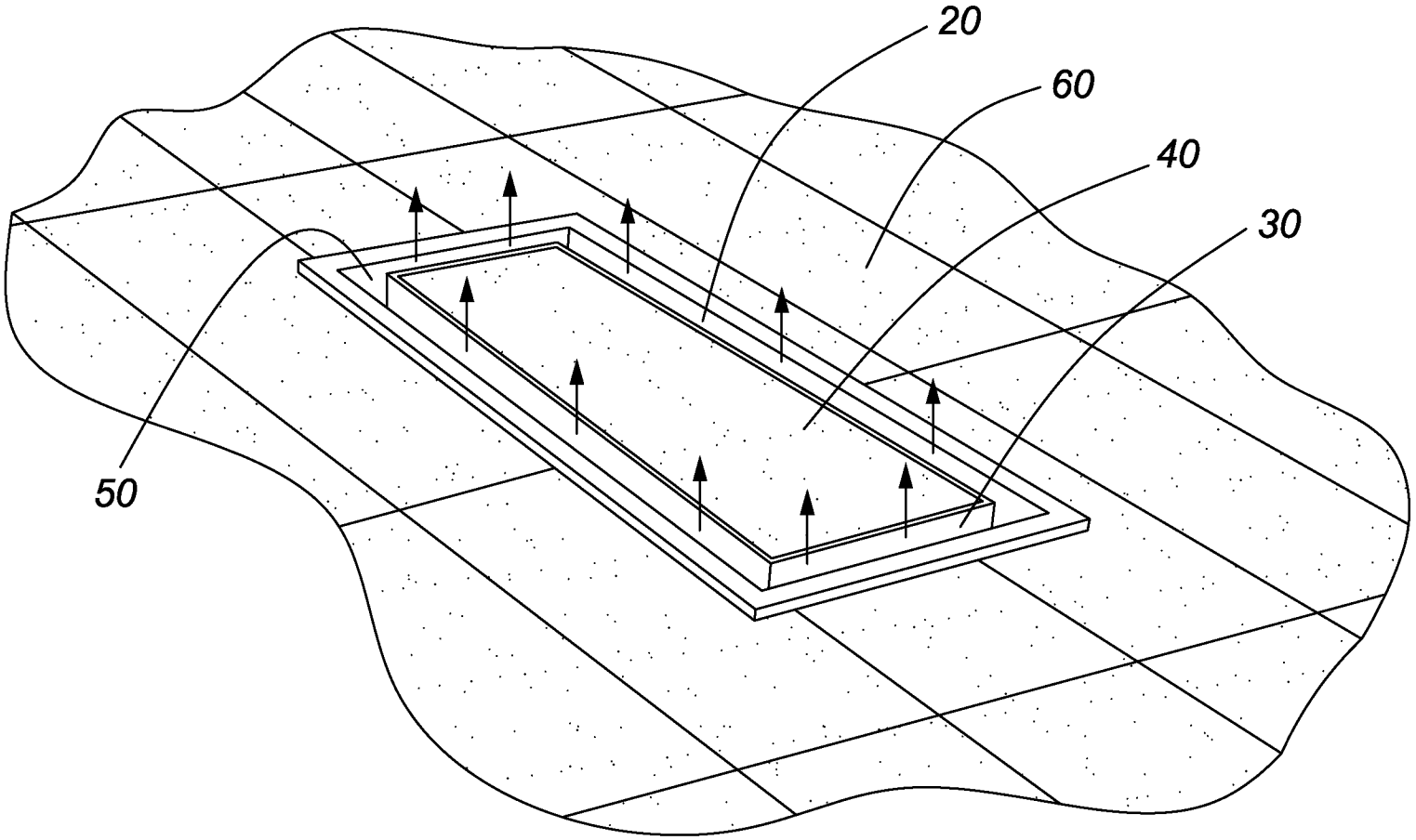
FIG. 1 is an illustration of a register assembly according to the present invention installed within a floor.

The insert (30) (see FIG. 4) also resembles an open top box comprising a bottom surface (140) and two pairs of opposing sidewalls (160, 170) enclosing an interior. The insert (30) is sized and dimensioned to be nested and restrained within the register body (20) so that the body (20) and insert (30) are coplanar with one another, and with the surrounding floor, ceiling or wall. There is also at least one support (100) disposed within the register body thereby ensuring there is a conduit (FIG. 1, 50) formed between the insert (30) and the body (20) when the insert (30) is inserted and restrained within the body (20). The arrows in FIG. 1 represent the movement of air out of the register assembly (10) from a first environment to a second environment.

The conduit (50) is in communication with the body bottom surface opening (70) and permits air to flow from the first environment to the second environment. Said first and second environments contemplates a variety of situations, including, ventilating a room inside a building with air from outside the building, providing air flow between two rooms in a building, and providing heated or cooled air from an air duct to a room.

In a preferred embodiment, the register body (20) and insert (30) are manufactured from a suitable metal or plastic. To create the bottom opening (70) in a metal register assembly according to the present invention, the body bottom surface (150) is cut or stamped out along lines (C3) and (C4) as shown in FIG. 4A. An advantage of this method is that the support (100) for the insert (30) is integrated with the the register body (20) as will be described. The now moveable portions of the bottom surface (150) are folded upwardly along lines C-D until perpendicular to the bottom surface (150). A second fold downward towards the bottom surface (150) is made along lines E-F. The two folds result in an L-shaped support (100), extending upwardly from the bottom surface (150) of the register body (20), as shown at the right-hand side of FIG. 4A and in FIG. 4C. The left-hand portion of FIG. 4A and corresponding FIG. 4B show the register body (20) prior to the first and second folds at lines C-D and E-F.

Figure 4A:
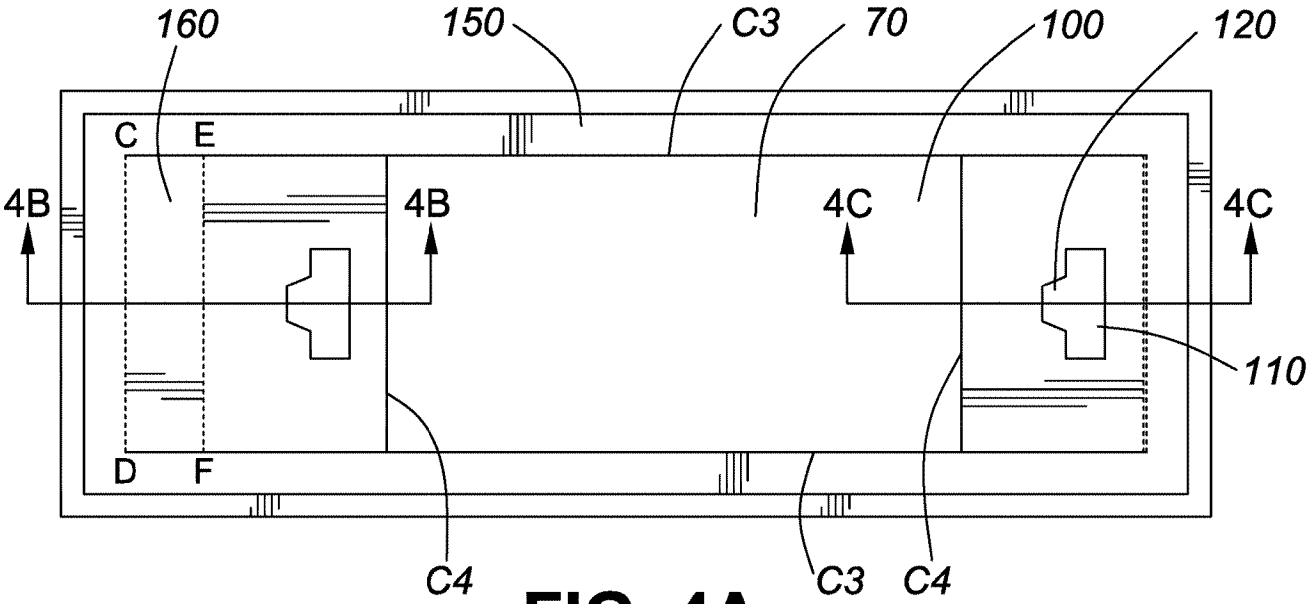
FIG. 4A is a top plan view of a register body of the register assembly showing cut and fold lines.
Figure 5:
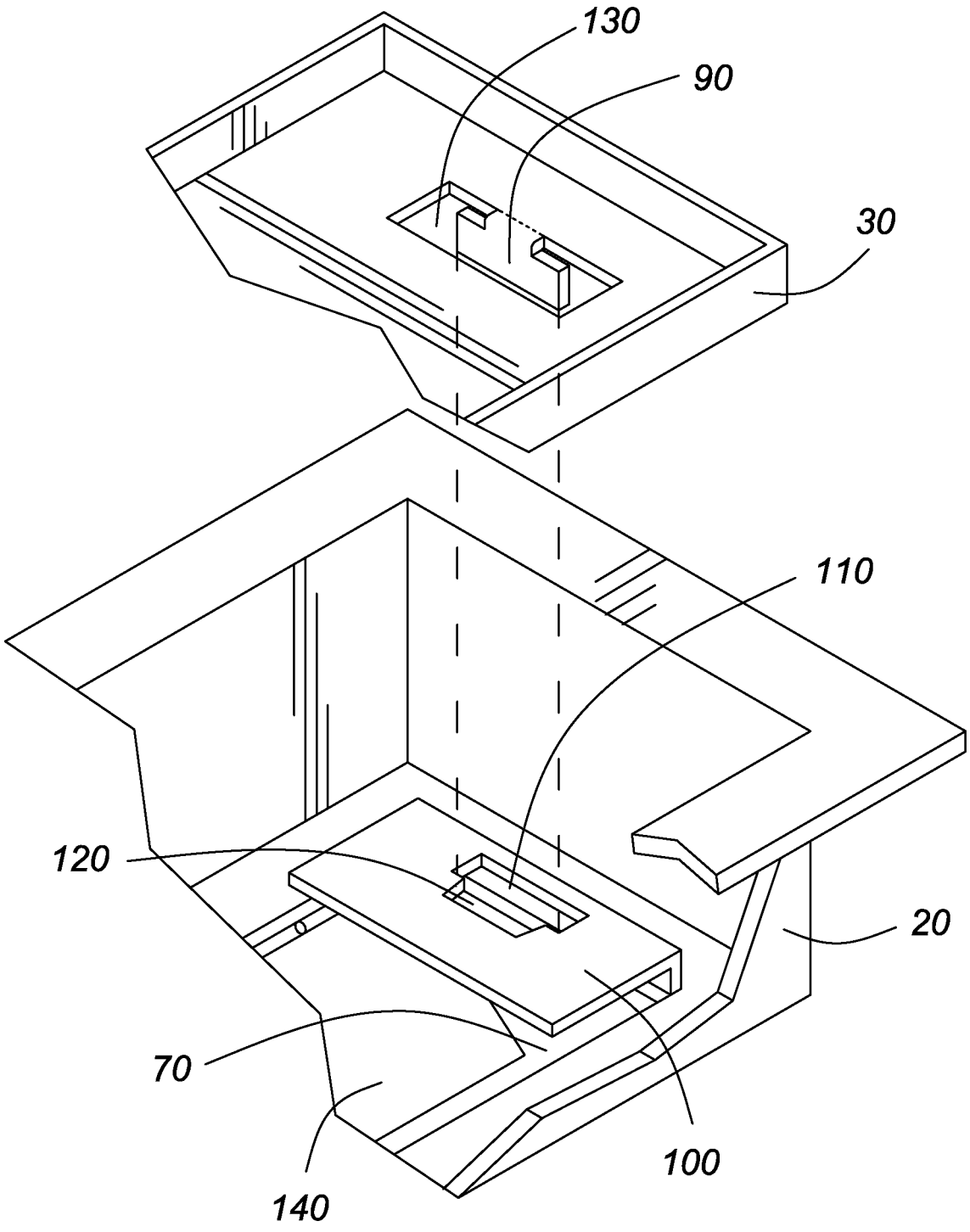
FIG. 5 is a cut away view of the the register body and insert illustrating a means by which the register body and insert re secured to one another.

A restraint is used to restrain the insert (30) within the body (20). In a preferred embodiment, said restraint is a cooperative engagement between the insert (30) and the body (20). An example of a cooperative engagement, in the form of a male-female locking mechanism, is shown in FIG. 5. An opening having a narrow portion (120) and a wide portion (110) can be created in each of the L-shaped supports (100) (FIGS. 4A and 5). The openings (110, 120) form the female portion of a male-female locking mechanism to restrain the insert (30) within the body (20).

Figure 3:
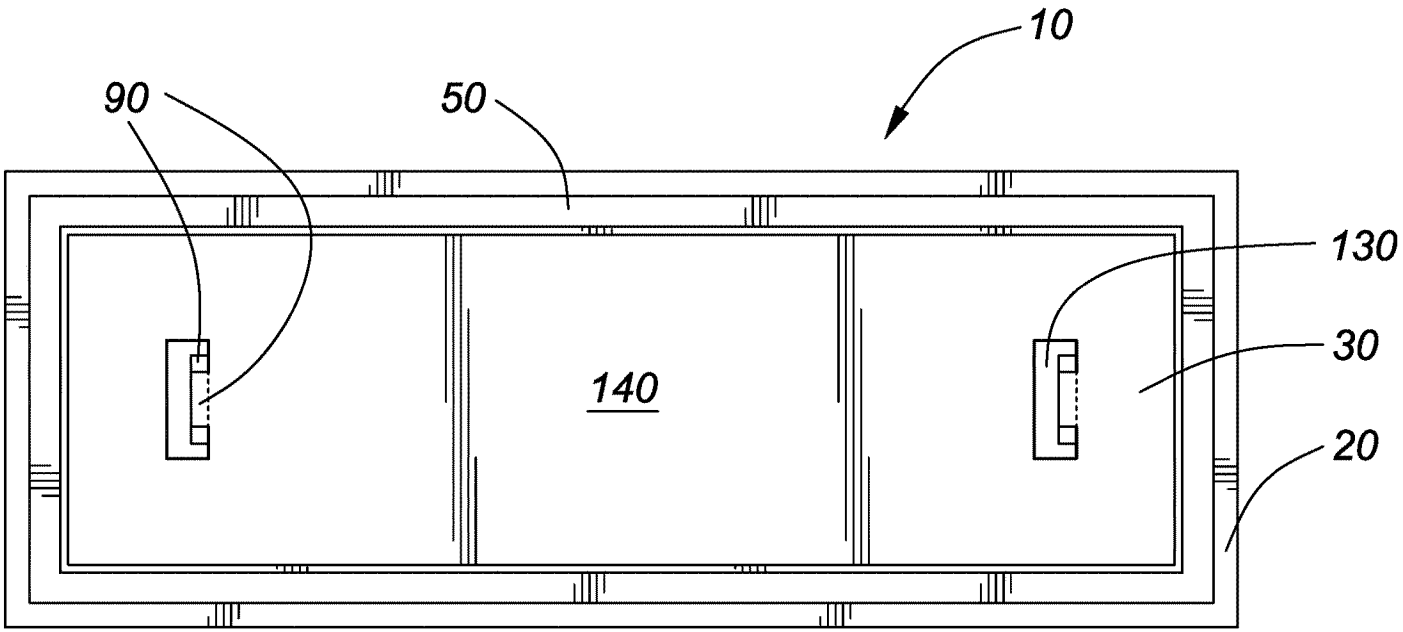
FIG. 3 is a top plan view of the register assembly.
Figure 3A:
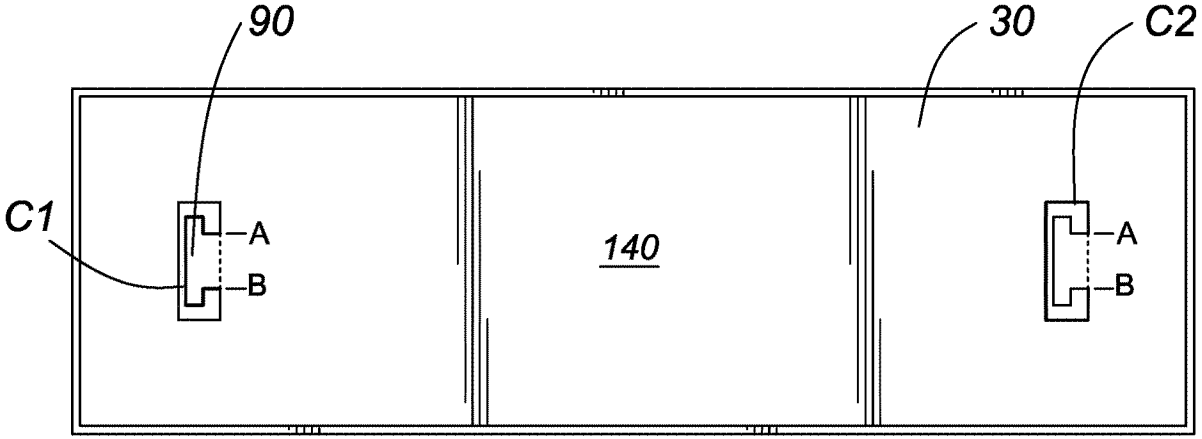
FIG. 3A is a top plan view of an insert for the register assembly showing cut and fold lines.
Figure 4:
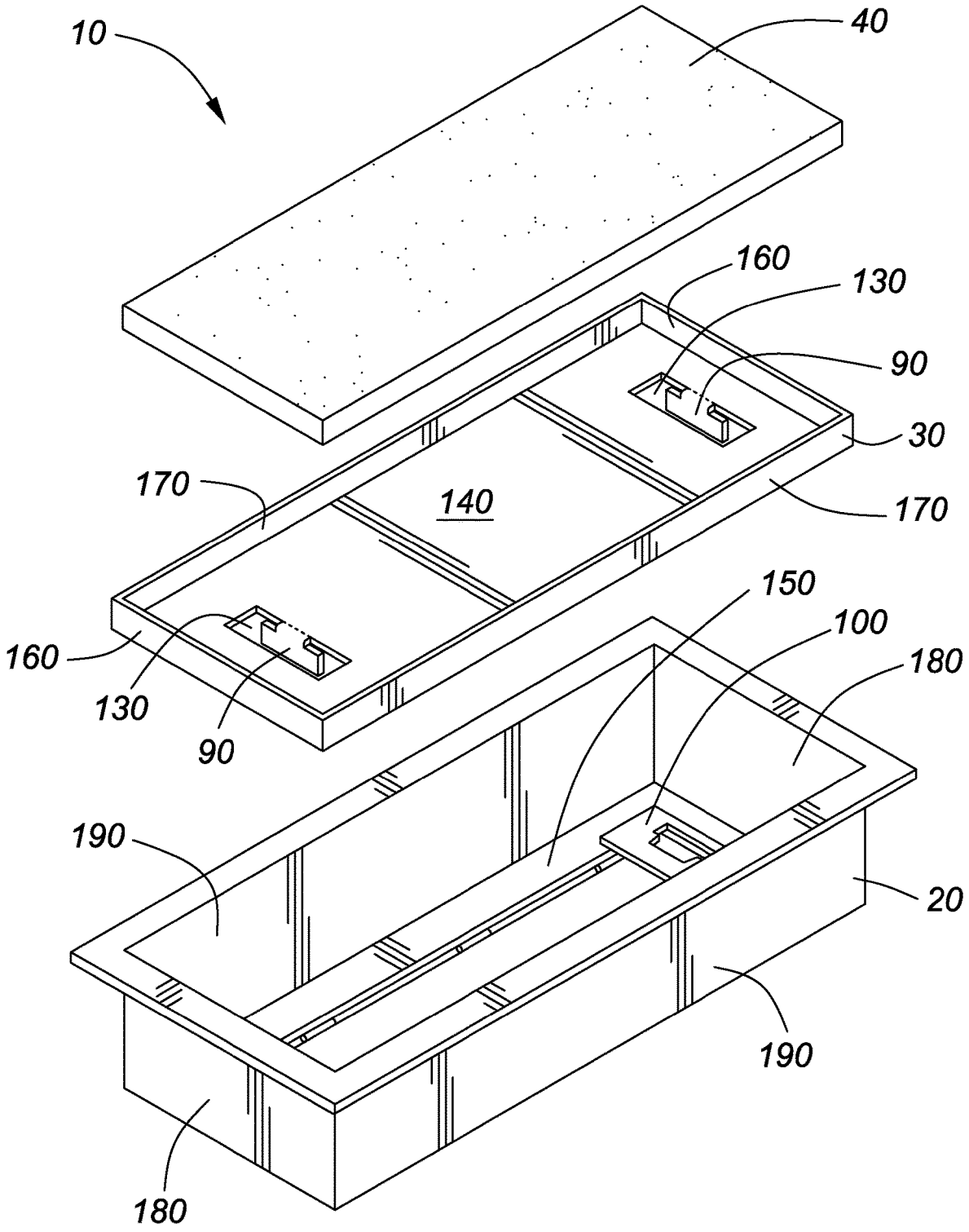
FIG. 4 is a perspective view of the three individual components of the register assembly shown in FIG. 1.
Figure 4C:
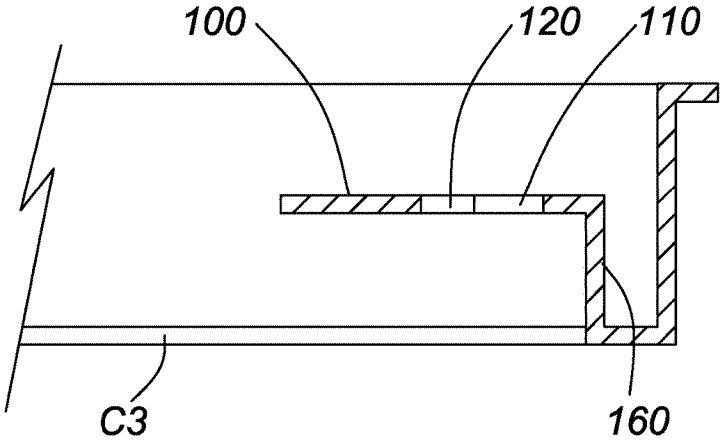
FIG. 4C is a cross-section through line 4C-4C.
Figure 4B:
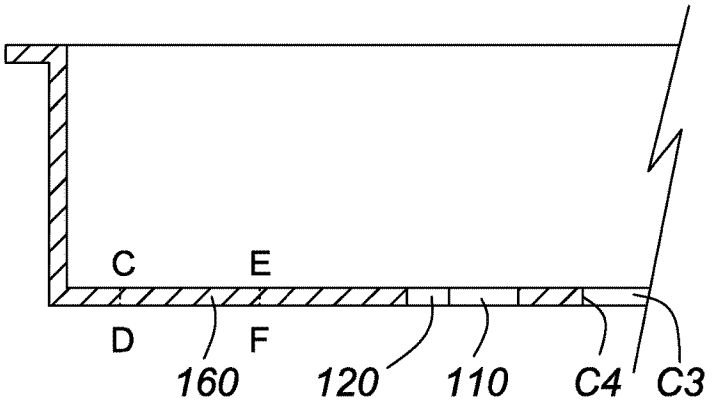
FIG. 4B is a cross-section through line 4B-4B.

To create the male portion, the bottom surface (140) of the insert (30) can be modified to have two openings (130) from which T-shaped projections (90) extend (FIGS. 3 and 4). To create the openings, the insert bottom surface (140) is cut or stamped out along line C1 and folded downwardly along lines A-B away from the bottom surface of the insert (140). This results in a T-shaped projection (90) that extends orthogonally from the bottom surface of the insert (30; see FIG. 4 and FIG. 5). Optionally, bottom surface (140) can be cut or stamped out along line C2 (FIG. 3A) to create the rectangular opening (130) as illustrated in FIG. 4 and FIG. 5.

As illustrated in FIG. 5, the T-shaped projection (90) of the insert (30) is inserted into the opening wide portion (110) of the register body L-shaped support (100). Once inserted, the T-shaped projection (90) can be slideably inserted into the opening narrow portion (120), thereby restraining and locking the insert (30) onto the register body support (100).

The T-shaped projection (90)/L-shaped support (100) combination is not the only means of securing the insert (30) to the body (20). Many other types of male-female connectors, adhesives and connectors can be used to accomplish the same function.

To complete the register assembly, a faceplate (40) can be installed within the insert (30). The faceplate (40) (FIG. 1 and FIG. 4) is removable and customizable so that any type of faceplate can be inserted within the insert (30). The faceplate (40) is easily manufactured to match the surrounding wall, ceiling or floor. The surrounding floor, ceiling or wall can be any one of marble, carpet, granite, wall painted a particular colour, wall covered in wall paper, and any other suitable material. All that is required is a matching faceplate (40) cut to the appropriate size to fit within the insert (30). A homeowner can purchase a register body (20) and insert (30) and can easily manufacture a matching faceplate (40) using materials and tools at home.

In other embodiments, movement of air through the register can be controlled by attaching a damper (FIG. 2; 140) onto the the bottom surface (150) of the register body (20). In another embodiment, the faceplate (40) can be replaced with a humidifying unit.

In yet another embodiment, the register body (20) can be manufactured to be installed in an "undermounted" fashion to make the register assembly even less visible.

What is claimed is:

1. An air vent register assembly for inserting into one of floors, ceilings and walls, comprising:

a first open top box having a bottom surface defining a centrally disposed opening through which air flows from a first environment to a second environment;

a support disposed within the first open top box;

a second open top box for nesting within the first open top box, the second open top box having an exterior surface, the exterior surface comprising a bottom surface and at least one sidewall surface, wherein the second open top box is supported by the support;

a restraint associated with the first and second box, to restrain the second box within the first box;

wherein the first and second open top boxes are sized and dimensioned to be coplanar with each other when nested; and wherein a conduit is defined between the first open top box bottom surface opening and the exterior surface of the second open top box to flow air from the first environment to the second environment.

2. The assembly of claim 1, wherein the support and restraint are integrated.

3. The assembly of claim 1, wherein the restraint is a male-female locking mechanism.

4. The assembly of claim 1, wherein the support is a plurality of L-shaped supports having a first portion extending orthogonally from the bottom surface of the first open top box, and a second portion extending orthogonally from said first portion; wherein the second portion defines a receptacle to matingly receive a projection extending from the second open top box, thereby securing the second open top box within the first open top box.

5. The assembly of claim 1, further comprising a faceplate inserted into the second open top box, wherein the faceplate is coplanar with the first and second box.

6. The assembly of claim 5, wherein the faceplate is manufactured to match any of the surrounding floor, ceiling and wall.

7. The assembly of claim 5, wherein the faceplate is any one of hardwood flooring, sponge, dry wall, stone, marble, veneer, laminate, painted wall and wallpapered dry wall.

8. The assembly of claim 1, wherein a closeable flap is attached to the bottom surface of the first open top box for damping air flow.

9. The assembly of claim 1, wherein the first and second open top boxes are manufactured from any of metal and plastic.

* * * * *